US010711390B2

(12) United States Patent
Christie

(10) Patent No.: US 10,711,390 B2
(45) Date of Patent: Jul. 14, 2020

(54) APPLIANCE VENTILATION ASSEMBLY

(71) Applicant: Dale Christie, Watervliet, MI (US)

(72) Inventor: Dale Christie, Watervliet, MI (US)

( * ) Notice: Subject to any disclaimer, the term of this patent is extended or adjusted under 35 U.S.C. 154(b) by 326 days.

(21) Appl. No.: 15/450,723

(22) Filed: Mar. 6, 2017

(65) Prior Publication Data

US 2017/0275808 A1 Sep. 28, 2017

Related U.S. Application Data

(60) Provisional application No. 62/313,315, filed on Mar. 25, 2016.

(51) Int. Cl.
*D06F 58/20* (2006.01)

(52) U.S. Cl.
CPC ..... *D06F 58/20* (2013.01)

(58) Field of Classification Search
CPC ..... F16L 53/00; D06F 58/20; D06F 58/10; Y10T 137/6525; F28F 2215/14
USPC .... 285/139.1, 139.3, 140.1, 141.1; 137/338; 34/140, 235
See application file for complete search history.

(56) References Cited

U.S. PATENT DOCUMENTS 3,647,934 A * 3/1972 Hurtt ..... H02G 3/0616 174/652
3,962,766 A * 6/1976 Pompidor ..... B29C 55/24 29/890.047
4,258,460 A * 3/1981 Melnyk ..... F16L 13/166 228/183
5,121,948 A 6/1992 Anderson et al.
5,145,217 A 9/1992 Anderson et al.
5,257,468 A 11/1993 Lebrun
5,318,328 A 6/1994 Dawson
5,967,567 A * 10/1999 Nordstrom ..... F16L 5/08 285/139.1
7,758,084 B2 * 7/2010 Boudry ..... F16L 47/24 285/139.2
2004/0237330 A1 12/2004 Fuller
2005/0052018 A1 * 3/2005 Pichotta ..... F16L 25/0018 285/9.1
2005/0184524 A1 * 8/2005 Stravitz ..... D06F 58/20 285/409
2005/0262718 A1 * 12/2005 Jung ..... D06F 58/20 34/140
2006/0162179 A1 * 7/2006 Kong ..... D06F 58/20 34/140
2017/0261271 A1 * 9/2017 Fanberg ..... F24D 19/008

* cited by examiner

*Primary Examiner* — David Bochna
*Assistant Examiner* — James A Linford
(74) *Attorney, Agent, or Firm* — Boudwin Intellectual Property; Daniel Boudwin

(57) ABSTRACT

An appliance ventilation assembly including an inlet pipe including a first end and a second end, wherein the first end is configured to connect to the back of a dryer and the second end is configured to partially insert into an outlet pipe. A front plate, an insert, and a back plate each include an opening adapted to receive the second end of the inlet pipe. The insert is disposed between the front plate and the back plate and is adapted to retain a press fit to the inlet pipe. The back plate includes an outlet pipe disposed on the back side. A rear end of the outlet pipe is configured to attach to an exterior pipe.

10 Claims, 3 Drawing Sheets

APPLIANCE VENTILATION ASSEMBLY

CROSS REFERENCE TO RELATED APPLICATIONS

This application claims the benefit of U.S. Provisional Application No. 62/313,315 filed on Mar. 25, 2016. The above identified patent application is herein incorporated by reference in its entirety to provide continuity of disclosure.

BACKGROUND OF THE INVENTION

The present invention relates to dryer vents. More specifically, the present invention includes an inlet pipe, a front plate, an insert, and a back plate wherein the inlet pipe connects to the back of a dryer and partially insert into an outlet pipe.

Dryers must have adequate ventilation in order to remove heat and lint generated from the operation thereof. When installing dryer vent systems there is limited space available to do the work. Dryers are typically fitted into a space straddled by walls, a washing machine, cabinets, or shelving. Conventional installation requires the dryer to be located four to six inches away from the wall in order to allow ductwork to be placed therebetween. Unfortunately, the ductwork consumes a large amount of unusable space between the dryer and the wall. Thus, there is a need for a dryer vent system that allows a dryer to be placed closer to the wall.

SUMMARY OF THE INVENTION

In view of the foregoing disadvantages inherent in the known types of dryer vents now present in the prior art, the present invention provides an appliance ventilation assembly wherein the same can be utilized for providing convenience for the user when installing a dryer close to the wall.

The present system comprises an inlet pipe including a first end and a second end, wherein the inlet pipe is tapered from the first end to the second end. The first end is configured to connect to the back of a dryer and the second end is configured to fasten to a front side of a back plate. The front plate, the insert, and the back plate each include a first opening, a second opening, and a third opening, respectively, adapted to receive the second end of the inlet pipe, wherein the insert is disposed between the front plate and the back plate and is adapted to retain a press fit to the inlet pipe. The back plate includes an outlet pipe disposed on a back side configured to be attached at the circumference of the third opening. A rear end of the outlet pipe is configured to attach to an exterior pipe.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
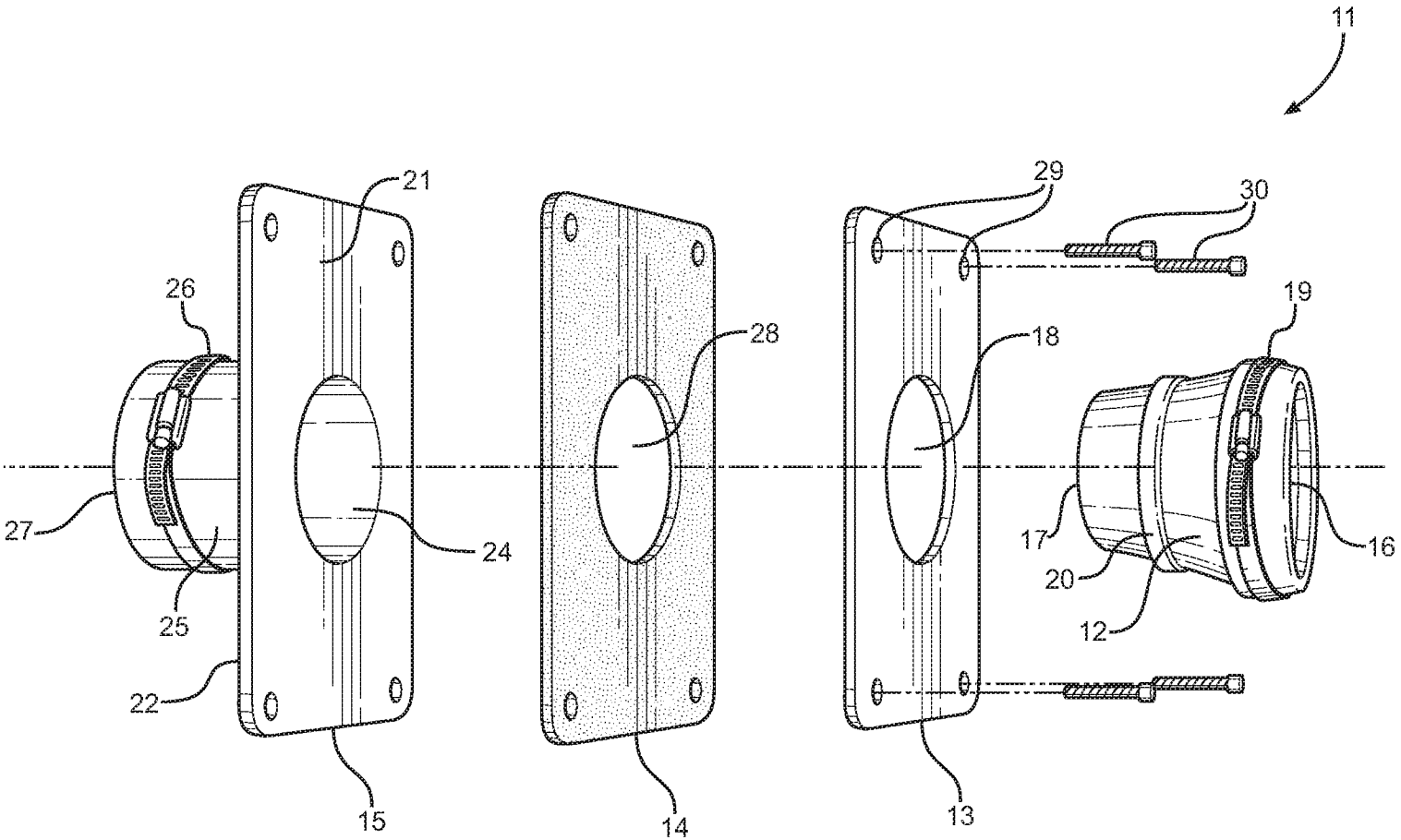
FIG. 1 shows an exploded view of the appliance ventilation assembly.

Reference is made herein to the attached drawings. Like reference numerals are used throughout the drawings to depict like or similar elements of the appliance ventilation assembly. The figures are intended for representative purposes only and should not be considered to be limiting in any respect.

Referring now to FIG. 1, there is shown an exploded view of the appliance ventilation assembly. The appliance ventilation assembly 11 includes an inlet pipe 12, a front plate 13, an insert 14, and a back plate 15. The inlet pipe 12 includes a first end 16 in fluid communication with a second end 17. In the illustrated embodiment, the inlet pipe 12 is tapered from the first end 16 to the second end 17, wherein the second end 17 is adapted to fit through a first opening 18 of the front plate 13, a second opening 28 of the insert 14, and a third opening 24 of the back plate 15 and provide a tight connection. However, in alternate embodiments, the inlet pipe 12 is not tapered.

The first end 16 includes a first clamp 19 disposed on the outer circumference to secure the inlet pipe 12 to an outlet of a dryer. In the illustrated embodiment, the first clamp 19 is a worm gear clamp. However, in alternate embodiments, the first clamp 19 is a vent gear clamp, stainless steel duct clamp, or any suitable clamp of any suitable material. The first clamp 19 helps secure and seal the inlet pipe 12 to the outlet of the dryer.

The inlet pipe 12 further includes a boss 20 disposed on the exterior circumference between the first end 16 and the second end 17. In the illustrated embodiment, the boss 20 is an integral, raised feature of the inlet pipe 12. However, in alternate embodiments, the boss 20 is a separate piece sized to fit around the outer circumference of the inlet pipe 12. A front side 21 of the back plate 15 receives the boss 20. The boss 20 and the second end 17 of the inlet pipe 12 are inserted through the first opening 18 of the front plate 13 and the second opening 28 of the insert 14 allowing the boss 20 to engage with the front side 21.

The appliance ventilation assembly 11 includes the front plate 13 and the back plate 15. In the illustrated embodiment, the front plate 13 includes the first opening 18 disposed towards the center thereof. The back plate 15 includes the front side 21 and a back side 22 wherein the back side 22 includes an outlet pipe 25. In the illustrated embodiment, the outlet pipe 25 extends 2½ inches out from the back plate 15. However, in alternate embodiments, the outlet pipe 25 is shorter than 2½ inches or longer than 2½ inches, such as the length of the wall thickness.

Figure 3:
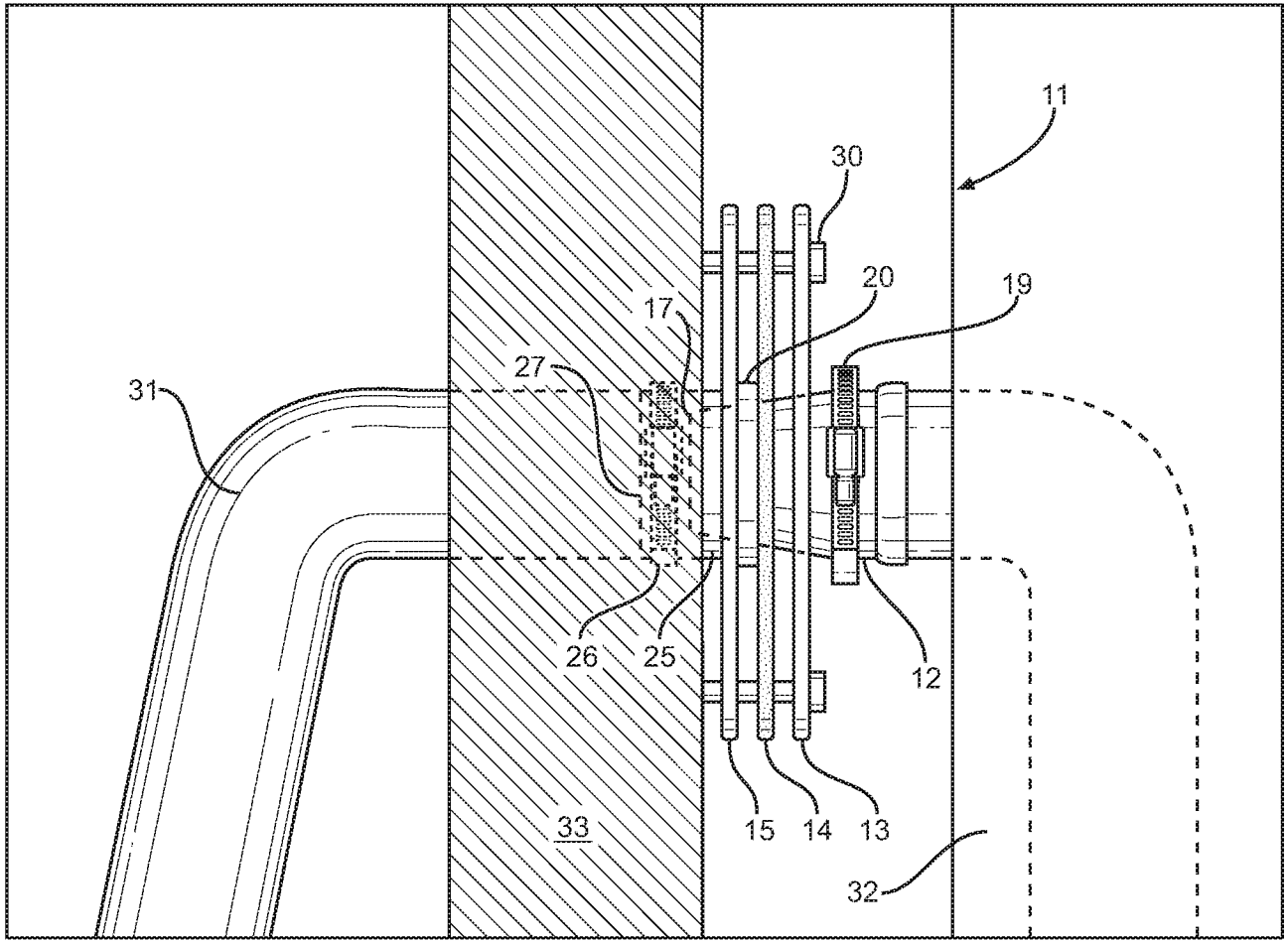
FIG. 3 shows a side view in use of the appliance ventilation assembly.

The back side 22 includes the outlet pipe 25 configured to be attached at the circumference of the third opening 24. The outlet pipe 25 extends through a wall adapted to attach to an exterior pipe 31 (as seen in FIG. 3). The outlet pipe 25 includes a second clamp 26 disposed on a rear end 27 to secure and seal the outlet pipe 25 to the exterior pipe. In the illustrated embodiment, the second clamp 26 is a worm gear clamp. However, in alternate embodiments, the second clamp 26 is a vent gear clamp, stainless steel duct clamp, or any suitable clamp of any suitable material.

The appliance ventilation assembly 11 includes the insert 14. The insert 14 is configured to fit between the front plate 13 and the back plate 15. The insert 14 includes the second opening 28 configured to be aligned with the first opening 18 and the third opening 24. The insert 14 is composed of a flexible material wherein the flexible material is adapted to retain a press fit to the inlet pipe 12. In the illustrated embodiment, the insert 14 is a rubber gasket. However, in alternate embodiments, the insert 14 is composed of silicone, EPDM (Ethylene propylene diene terpolymer), or any suitable type of material adapted to retain the press fit.

When one or more apertures 29 receive a fastener 30, a user may selectively bias the fasteners 30 such that the insert 14 places pressure against the boss 20 which in turn places pressure against the front side 21, thereby providing the inlet pipe 12 with a secure fit. The second end 17 of the inlet pipe 12 is partially inserted into the outlet pipe 25, wherein the inlet pipe 12 cannot be removed from the front plate 13, the insert 14, and the back plate 15 unless each of the fasteners 30 are removed.

In the illustrated embodiment, the front plate 13, the insert 14, and the back plate 15 are rectangular in shape. However, in alternate embodiments, the front plate 13, the insert 14, and the back plate 15 are any suitable shape, such as circular. In the illustrated embodiment, the front plate 13, the insert 14, and the back plate 15 are configured to be identical in length and width to allow for a compact assembly wherein length is defined as a long side and width is defined as a short side. However, in alternate embodiments, the front plate 13, the insert 14, and the back plate 15 are different in length and width.

The front plate 13, the insert 14, and the back plate 15 each comprise the first opening 18, the second opening 28, and the third opening 24, respectively, to receive the second end 17 of the inlet pipe 12. Each of the openings 18, 28, 24 are different in size to comprise a secure fit for the second end 17. The first opening 18 allows the boss 20 to fit therethrough. The second opening 28 is smaller than the first opening 18 to create the press fit with the inlet pipe 12. The third opening 24 is smaller than the first opening 18 to allow the second end 17 of the inlet pipe 12 to fit therein, which allows the boss 20 to engage with the front side 21.

Figure 2:
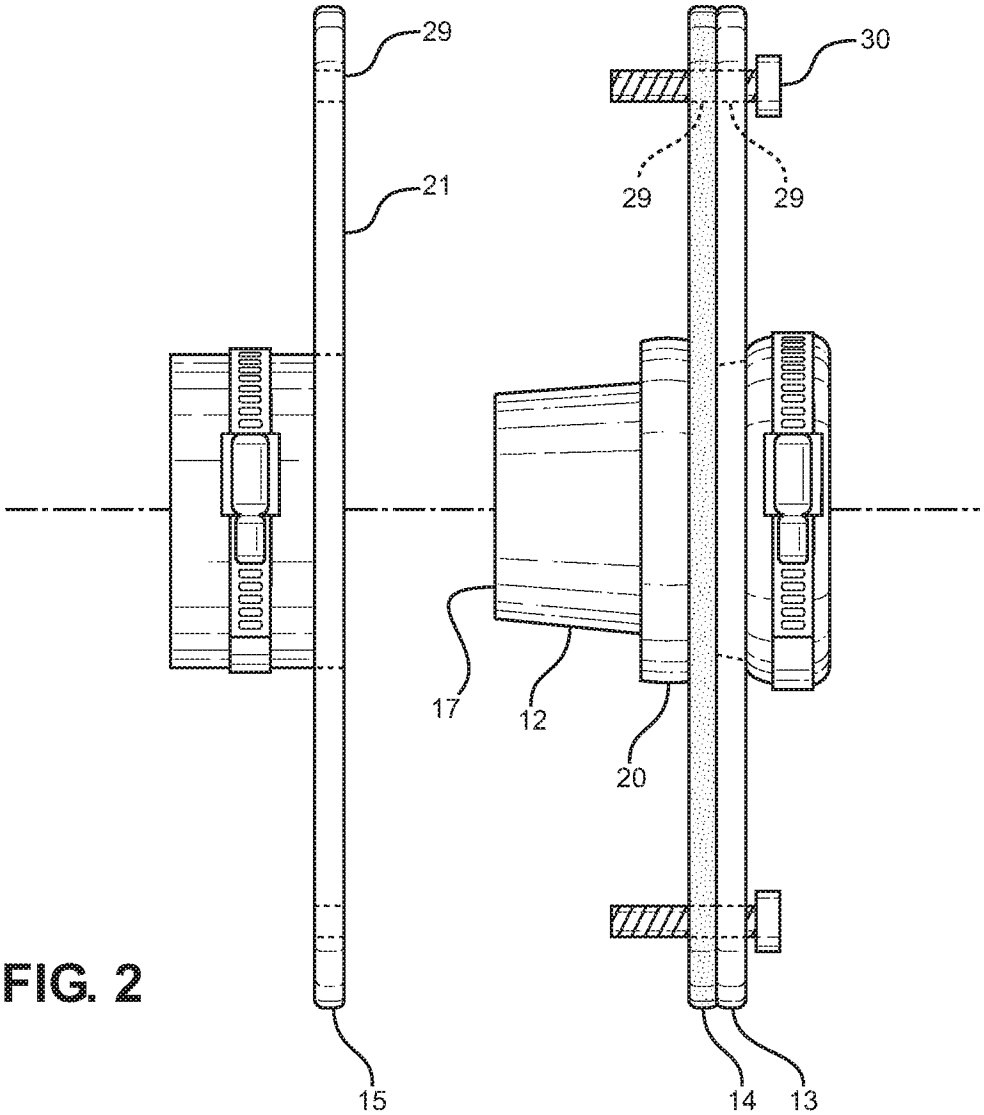
FIG. 2 shows a side view partially assembled of the appliance ventilation assembly.

Referring now to FIG. 2, there is shown a side view of the appliance ventilation assembly partially assembled. The front plate 13, the insert 14, and the back plate 15 each further comprise the one or more apertures 29 aligned with one another disposed on each corner of the front plate 13, the insert 14, and the back plate 15. Each of the one or more apertures 29 are configured to receive the fastener 30 to secure the front plate 13, the insert 14, the back plate 15, and the second end 17 of the inlet pipe 12 compactly. In the illustrated embodiment, the fastener 30 is a screw. However, in alternate embodiments, the fastener 30 is a nail, bolt, or any suitable type of fastener.

In the illustrated embodiment, the insert 14 and the front plate 13 are positioned on a side of the boss 20 disposed towards the first side of the inlet pipe 12. The front side 21 of the back plate 15 is configured to receive the boss 20 on the inlet pipe 12. The boss 20 and the second end 17 of the inlet pipe 12 are inserted through the first opening of the front plate 13 and the second opening of the insert 14 allowing the boss 20 to engage with the front side 21. When one or more apertures 29 receive a fastener 30, the insert 14 places pressure against the boss 20 which in turn places pressure against the front side 21, thereby providing the inlet pipe 12 with a secure fit.

Referring now to FIG. 3, there is shown a side view of the appliance ventilation assembly. In the illustrated embodiment, the front plate 13, the insert 14, and the back plate 15 are configured to be thin to allow for the compactness which enables the dryer 32 to sit closer to the wall 33 without the need for ductwork wherein thinness is measured horizontally in the direction of the fastener 30. In alternate embodiments, the front plate 13, the insert 14, and the back plate 15 are each a different thinness.

The outlet of the dryer 32 is affixed to the inlet pipe 12 to allow for fluid communication therebetween which is secured and sealed by the first clamp 19. The front plate 13 and the insert 14 are aligned with one another so as to receive the second end 17 and the boss 20 therethrough wherein the boss 20 comes in contact with the front side on the back plate 15. The front plate 13, the insert 14, and the back plate 15 are secured together with the fasteners 30 through the one or more apertures. The outlet pipe 25 is secured in a channel of the wall 33 which is affixed to the exterior pipe 31 at the rear end 27 and secured with the second clamp 26. In the illustrated embodiment, the exterior pipe slides over the outlet pipe 25. However, in alternate embodiments, the outlet pipe 25 slides over the exterior pipe. Moist air and lint from the dryer can flow unobstructed from the dryer 32, through the inlet pipe 12, through the outlet pipe 25, and exit through the exterior pipe 31.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An appliance ventilation assembly, comprising:

an inlet pipe in fluid communication with an outlet pipe, the outlet pipe including a back plate and a rear end;

a front plate and an insert, each including an opening configured to partially receive the inlet pipe;

wherein the front plate and the insert are entirely planar in shape;

the front plate configured to affix to the back plate via a fastener through apertures disposed through the front plate, insert and back plate, wherein the insert is disposed between the front plate and the back plate; and a press fit adapted between the inlet pipe and the insert.

2. The appliance ventilation assembly of claim 1, wherein the inlet pipe is tapered from a first end to a second end.

3. The appliance ventilation assembly of claim 1, wherein the insert is composed of a flexible material.

4. The appliance ventilation assembly of claim 1, wherein each of the front plate, the insert, and the back plate include one or more apertures, wherein the one or more apertures are selectively aligned with each other and configured to receive the fastener.

5. The appliance ventilation assembly of claim 1, wherein the inlet pipe includes a first clamp disposed on the first end, the first clamp adapted to secure the inlet pipe to an outlet of a dryer.

6. The appliance ventilation assembly of claim 1, wherein the outlet pipe includes a second clamp disposed on the rear end, the second clamp adapted to secure the outlet pipe to an exterior pipe allowing fluid communication between the outlet of a dryer and the exterior pipe.

7. The appliance ventilation assembly of claim 1, wherein the front plate and the back plate are of an identical diameter.

8. The appliance ventilation assembly of claim 1, wherein the front plate, the insert and the back plate define an entirely flat edge along the perimeter thereof.

9. The appliance ventilation assembly of claim 1, wherein the back plate and the outlet pipe form a single, unitary piece.

10. The appliance ventilation assembly kit comprising:

an inlet pipe tapered from a first end to a second end, wherein a boss is disposed between the first end and the second end;

a front plate comprising a first opening;

an insert comprising a second opening, wherein the insert is composed of a flexible material;

wherein the front plate and the insert are entirely planar in shape;

a back plate including a front side and a back side, wherein the back side includes an outlet pipe disposed thereon;

a plurality of apertures disposed on the front plate, the insert, and the back plate, the plurality of apertures configured to receive a fastener;

the front plate and the back plate being of an identical perimeter;

a first clamp disposed on the first end of the inlet pipe; and a second clamp disposed on a rear end of the outlet pipe.

* * * * *